United States Patent [19]

Buck et al.

[11] 4,274,702

[45] Jun. 23, 1981

[54] ANTIROTATION MEANS FOR WIRE WRAP ELECTRICAL CONNECTOR ASSEMBLIES

[75] Inventors: Joseph M. Buck, Binghamton; David O. Gallusser, Oneonta; David L. Frear, Binghamton, all of N.Y.

[73] Assignee: The Bendix Corporation, Southfield, Mich.

[21] Appl. No.: 94,138

[22] Filed: Nov. 14, 1979

[51] Int. Cl.[3] ..... H01R 4/14; H01R 13/52

[52] U.S. Cl. ..... 339/217 R; 339/94 M; 339/276 A

[58] Field of Search ..... 339/217 R, 217 S, 276 A, 339/94 R, 94 M

[56] References Cited

U.S. PATENT DOCUMENTS

| | | | |
|---|---|---|---|
| 3,365,539 | 1/1968 | Bratsch | 339/276 A X |
| 4,082,398 | 4/1978 | Bourdon et al. | 339/217 S X |

FOREIGN PATENT DOCUMENTS

| | | | |
|---|---|---|---|
| 2350775 | 4/1975 | Fed. Rep. of Germany | 339/276 A |

*Primary Examiner*—Eugene F. Desmond

*Attorney, Agent, or Firm*—William G. Kratz, Jr.; Raymond J. Eifler; Charles D. Lacina

[57] ABSTRACT

An antirotational means to prevent rotation of contacts retained in a dielectric insert during wire wrapping of the noncircular terminals attached thereto comprises a template 31 secured to the grommet of the assembly, the template having a plurality of apertures 35 therein and a plurality of grooves 37 therein cooperating with the apertures 35, and a plurality of locking elements 33 having lugs 41 thereon and a bore 43 therethrough, with the locking elements matable with the apertures of the template while the noncircular terminals 21 extend through the bore 43 to prevent rotation of the terminal 21 and contact 7, retained with a dielectric insert 3, during wire wrapping of the terminal.

4 Claims, 6 Drawing Figures

ANTIROTATION MEANS FOR WIRE WRAP ELECTRICAL CONNECTOR ASSEMBLIES

BACKGROUND OF THE INVENTION

The present invention relates to electrical connector assemblies wherein insertable and removable contacts are situated within passages formed in a dielectric insert. More specifically, the invention is directed to such assemblies wherein the contacts have noncircular terminals extending from the rear face of the dielectric insert or grommet. These terminals are connected to electrically conductive wire that is wrapped about the terminals.

In electrical connector assemblies having contacts situated in dielectric inserts, with noncircular terminals or tails extending from the rear face of the insert, the connecting wires to the terminals are generally conductively connected thereto by means of wrapping wire about the terminals with a wire wrapping tool. The tool, upon rotating of the wire about the noncircular terminal, often causes the contact to also rotate in the insert, which leads to a less secure connection than desired. One means of reducing the undesired rotation of the contact during wire wrapping of the noncircular terminals is to join the contact, either male or female, with an associated contact, either female or male, within the connector mechanism, prior to wire wrapping the terminal. While such a method does, to some extent, slow the rotation of the contact, the terminal of which is being wrapped, such method does not eliminate such undesired rotation.

It is an object of the present invention to provide means for wire wrapping of the terminals of contacts, which terminals extend from the rear face of a dielectric insert, and from an associated moisture sealing grommet, without the need to mate the contacts with their associated contacts of an electrical assembly.

It is another object of the present invention to provide means to prevent rotation of contacts of an electrical connector assembly in a dielectric insert during wire wrapping of the noncircular terminals of the contacts.

It is a further object of the present invention to provide an electrical connector assembly which contains an insert having contacts therein, and an associated moisture sealing grommet, and means secured to the grommet to prevent rotation of the contacts during wire wrapping of the non-circular terminals of the contacts.

It is yet another object of the present invention to provide means for wire wrapping of the noncircular terminals of contacts retained in a conventional dielectric insert with conventional wire wrapping tools, and preventing rotation of the contacts during the wire wrapping process.

SUMMARY OF THE INVENTION

The present invention is an electrical connector assembly having means for preventing rotation of contacts, contained in inserts, during wire wrapping of the noncircular terminals of such contacts. The connector assembly is characterized by a dielectric insert 3 and associated grommet 9, having axial passages 7 and 26 contained therein, with contacts 5 retained within the insert 3 having noncircular terminals 21 which extend through apertures 35 in a dielectric template 31 secured to the rear face 25 of the grommet 9. Locking means 33 are provided, which have a bore 43 therethrough, that are placed over the terminal 21, and lugs 41 on the locking elements mate with grooves 37 cooperating with apertures 35 in the template 31 to prevent rotation of the terminal 21 and contact 5 during wire wrapping of the terminal. A slot 39 is also provided in the template 31 cooperating with apertures 35 to permit access to the edge of the locking element 33 for removal of the locking element in the event that the contact 5 is to be removed from securement within the insert 3.

DETAILED DESCRIPTION

Figure 1:
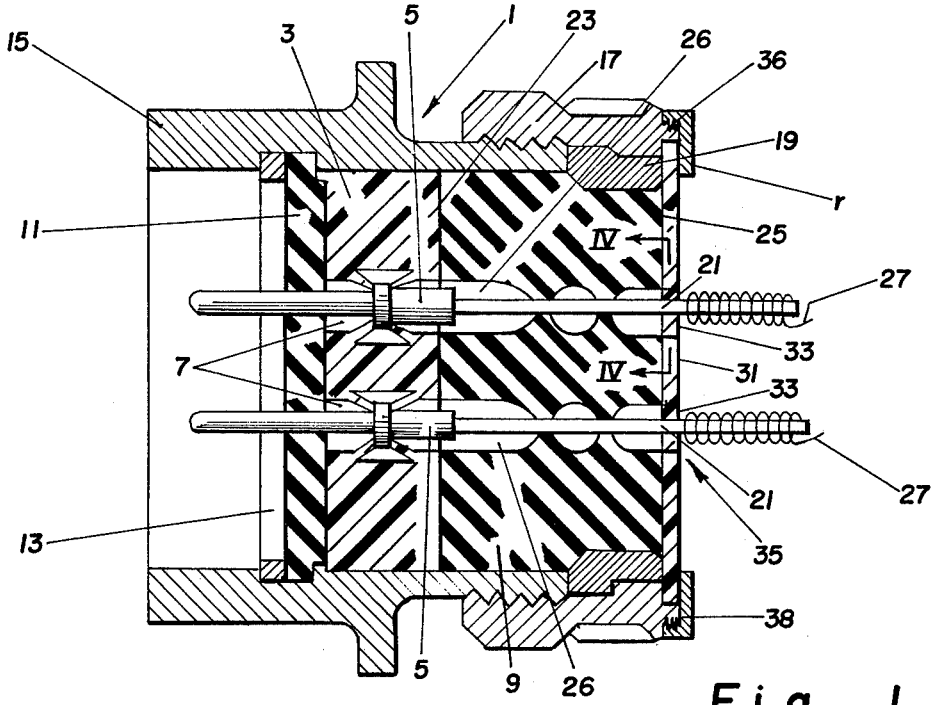
FIG. 1 is a cut-away view of a plug portion of an electrical connector assembly showing the antirotation means secured to the grommet.

Referring now to the drawings, the electrical connector assembly of the present invention is illustrated, the assembly having means for preventing rotation of a contact, situated in a dielectric insert, during wire wrapping of the terminal of the contact.

In FIG. 1, a half of an electrical connector assembly is shown, the half containing the male contacts (pins) that are mateable with female contacts (sockets) in forming a completed electrical connector assembly. It is to be understood that the present invention is usable with the female contact assembly as well as the male contact assembly illustrated, although, for the purpose of brevity, only use of the wire wrapping means of the present invention in wire wrapping of the illustrated male type contact assembly will be shown. The assembly illustrated in FIG. 1 shows an electric connector 1 which includes a contact retaining insert 3 formed of dielectric material, a plurality of contacts 5 retained in axial passages 7 formed in the insert, a rear moisture sealing grommet 9, a front moisture sealing grommet 11, a front retaining ring 13, a connector shell 15, a retaining nut 17, and a rear retaining ring 19. The insert is formed of a dielectric material such as those suggested for use in the inserts of U.S. Pat. No. 4,082,398, assigned to the assignee of the present invention, and incorporated by reference herein. The contacts 5 are the type which terminate as a noncircular terminal 21 extending from the rear 23 of the insert 3, and which extend from the rear sealing grommet 9, through the rear face 25 thereof, the terminals extending axially through passage 7 in the insert 3 and through cooperating passages 26 in rear grommet 9. The noncircular terminals 21 are adapted to be connected to wires 27 by wrapping the wires 27 about the terminals. The assembly defined to this point as a conventional electrical connector assembly the contacts of which are adapted to be connected to wiring by wire wrapping. Such wire wrapping is effected using conventional tools (not shown) which generally comprise a cylindrical like extension that fits over the terminal and flush with the rear grommet face 25, and which wraps the wire about the terminal by rotation and by affixing of exposed conductive wire to the terminal. Generally, the terminals 21 are of a square cross-section, although other noncircular cross-sectional configurations may be used.

When the terminal 21 is wrapped with wire by means of a wire wrapping tool, the contact 5 has a tendency to rotate within the insert 3, due to rotational forces exerted on the terminal 21, and it is to the prevention of such rotation of the contact 5 to which the present antirotation means is directed.

The means for preventing rotation of the contacts 5 and associated terminals 21 during wire wrapping of the terminals comprises a template 31 formed from a dielectric material, such as that used in forming the insert 3, and locking elements 33, of like dielectric material, which are mated within apertures 35 in the template. As illustrated, the template 31, which is a disc shaped or plate like element, is secured to the face 25 of the grommet 9 from which the terminals 21 extend, and may be secured thereto by means of a ring r that has threads 36 therein which coact with threads 38 on the retaining nut 17. While this means of securing the template 31 to the rear of the connector assembly is shown, other such means may be equally as useful, such as having a threaded ring coacting with threads on the extension of the compression ring 19, or by affixing the template 31 directly to the rear face of the grommet 25 by adhesive means, such as an epoxy resin.

Figure 2:
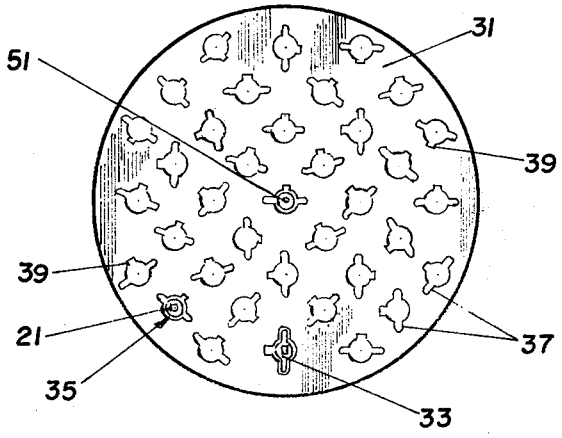
FIG. 2 is a rear elevational view of the template portion of the assembly of the present invention.

The template 31, illustrated in FIG. 2, has a plurality of apertures 35 therethrough, with at least one aperture 35 provided for each axial passage 7 in the insert 3, and cooperating passages 26 in the grommet 9. These apertures 35 are sized so as to enable passage of the contact 5 through the aperture 35, then through cooperating passage 26 and into passage 7, and retaining of contact 5 within the insert 3. When so retained, the terminal 21 will extend outwardly from the rear face of the template 31. The template 31 has at least one groove 37 which cooperates with each aperture 35, with two such grooves 37 preferred, the two grooves 37 when present bein offset from each other by 180°. In addition to the grooves 37, slots 39 are also provided within the template 31 with a slot cooperating with each aperture 35 and preferably offset by 90° from the grooves 37.

Figure 3:
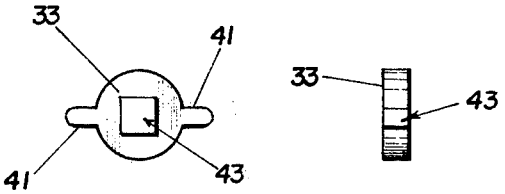
FIG. 3 is a plan view and cross-sectional view of the locking element of the present invention.

Locking elements 33, FIG. 3, formed from dielectric material, are provided which mate with the apertures 35 of template 31 as follows. The locking elements 33 are formed preferably of the same dielectric material as is used to form the template 31, and the thickness of the locking element preferably conforms to the thickness of the template. Each locking element 33 has at least one lug 41 provided on the periphery thereof, which lugs will mate with the grooves 37 in the template 31. A noncircular bore 43 is provided through the locking element 33 which is sized so as to enable placement of the locking element over a terminal 21.

As previously described, the template 31 is secured to the rear face 25 of the grommet 9 and the contacts 5 are inserted through apertures 35 in the template and secured in the passages 7 within the dielectric insert 3. The noncircular terminals will thus extend out through the aperture 35 of template 31. A locking element 33 is then placed over the terminal 21, with the terminal passed through bore 43 in the locking element 33, and the locking element 33 advanced towards the template 31 until the same will mate within the apertures 35 of the template. With the lugs 41 positioned within grooves 37 of the template and the noncircular terminal positioned within the bore 43 that has the same configuration as the terminal, the terminal 21 will be precluded from rotating upon wrapping of the terminal by means of a wire wrapping tool. By precluding rotation of the terminal 21, the contacts 5 attached thereto will also be precluded from rotational movement during wrapping of the terminal.

Figure 4:
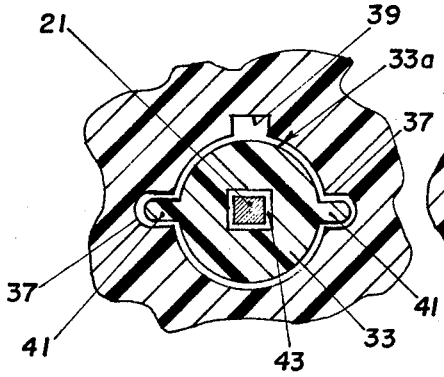
FIG. 4 illustrates a cross-sectional view taken along the lines IV—IV of FIG. 1.

Referring now to FIG. 4, the engagement of the locking element 33, placed over the terminal 21, is illustrated. The lugs 41 on the locking element 33 mate with the grooves 37 in the template 31, while the terminal 21 extends through the bore 43 of the locking element 33, thus providing an antirotational means for use in wrapping of the wire about the terminal. The slot 39 exposes an end portion 33*a* of the locking element such that the locking element 33 may be pried loose from the mating relationship with template 31 if the contact 5 is to be removed from the insert for examination, repair, or the like. The template 31 thus can remain secured to the rear face 25 of the grommet 9 while one or more contacts are removed from the insert 3 and replaced therein. While the slot 39 is preferred to enable removal of the locking element 33 from template 31, such removal may also be effected by shortening of a lug 41 on the locking element 33, while still providing a mating relationship of that lug with a groove 37, to expose an edge portion of the locking element and permit prying of the locking element 33 from its mated relationship within the aperture 35 of the template 31.

Figure 5:
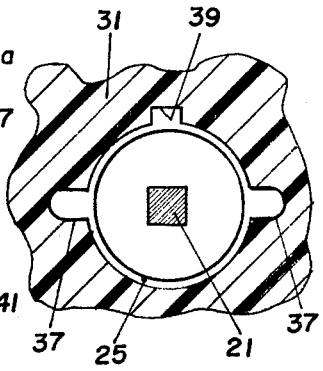
FIG. 5 illustrates a view as in FIG. 4 but with the locking element removed from the template.
Figure 6:
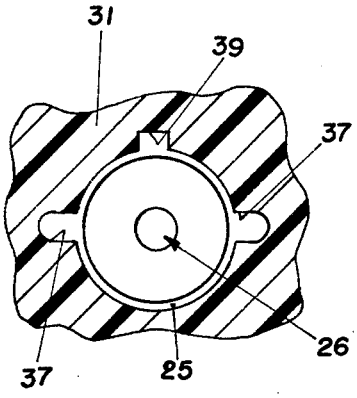
FIG. 6 illustrates a view as in FIG. 4 but with the template and locking element removed and prior to insertion of a contact within the passage of the grommet.

In FIG. 5, the template 31 has been secured to the rear face 25 of the grommet 9, but a locking element is not mated within the aperture 35 of the template 31. The contact 5 is, however, inserted in the passage 26 and the noncircular terminal 21 extends outwardly therefrom. Such a case would exist where a contact has been inserted through the passage 26 prior to placement of the locking element 33 over the terminal 21, or upon removal of a locking element 33 from securement within the aperture 35 of the template 31. A portion of the rear face 25 of the grommet 9 is thus exposed. In FIG. 6, the case is illustrated where the template 31 has been secured to the rear face 25 of the grommet 9, and a passage 26 is exposed prior to insertion of the contact therethrough, or after removal of both a locking element 33 and a contact 5 from an assembled unit.

The present assembly permits wire wrapping of terminals of contacts while preventing rotation of the contacts and also ready removal and replacement of the contacts from the insert while the template is secured to the rear grommet.

What is claimed is:

1. In an electrical connector assembly having a plurality of electrical contacts and a dielectric insert member associated with a moisture sealing grommet member, each of said members having forward and rearward faces and each including a plurality of passages extending between their respective said faces, the rearward face of the insert abutting the forward face of the grommet and the passages of one member being associated with the passages of the other member such that the passages of each are axially aligned, each of the contacts being mounted within one respective passage of the insert and each having a non-circular terminating end portion extending from the rearward face of the grommet, said non-circular terminating end portions being adapted to electrically terminate a wire wrapped therearound, the improvement comprising:

means for separately preventing each individual contact from rotating relative to its associated passages, the rotation preventing means comprising:

a locking template secured to the rear of the grommet, said template having a plurality of apertures extending therethrough and through which the contacts will pass, each of the apertures being in register with the associated passages and each having at least two locking grooves cooperating therewith;

a plurality of locking elements of dielectric material, each of said locking elements being shaped to fit within one of the apertures in the locking template and each having at least two locking lugs extending outwardly therefrom and adapted to be received within the locking grooves of the template to prevent the locking element from rotating relative to its associated groove, each locking element being provided with a non-circular bore through which the non-circular terminating end portion of the contact extends and thereby hold the contact against rotation upon wrapping of the terminal with a conductive connecting wire; and at least one unlocking slot cooperating with each of said apertures.

2. In an electrical connector assembly as defined in claim 1, the improvement wherein said two locking grooves are diametrical to each other.

3. In an electrical connector assembly as defined in claim 1, the improvement wherein said terminating end portion is of square cross-section and the bore through the locking element is of square dimension to provide a cooperating fit therebetween.

4. In combination, an electrical connector assembly having a forward mating end and a rearward terminating end and characterized by:

a contact retaining insert of dielectric material having forward and rearward faces and an axial passage extending therebetween;

a moisture sealing grommet of electrically non-conductive material having forward and rearward faces and an axial passage extending therebetween, the forward face of the grommet being associated with the rearward face of the insert;

a locking template having forward and rearward faces and an aperture extending therebetween, the forward face of the template being associated with the rearward face of the grommet, said association of the insert, grommet and template being such that the axial passages and the aperture thereof are axially aligned one to the other;

said aperture including a pair of cooperating grooves;

an electrical contact of conductive material mounted in the passage of said insert, said contact having a contacting section exposed at said forward mating end and a terminating section exposed at said rearward terminating end, said terminating section including a portion thereof having a generally square cross-section, said contact being sized to fit through the passage of said grommet and insert; and a locking element of dielectric material, said element being adapted to fit within the aperture of the locking template and including a pair of locking lugs extending outwardly therefrom and a bore centrally disposed therein, the locking lugs sized to fit within the cooperating grooves to thereby secure the locking element against rotation relative to the locking template and the bore being of square cross-section and sized to receive the terminating section of the contact to thereby secure the contact against rotation relative to the assembly.

* * * * *